US007073677B2

(12) United States Patent
Richardson et al.

(10) Patent No.: US 7,073,677 B2
(45) Date of Patent: Jul. 11, 2006

(54) SECURE TRASH CONTAINER ASSEMBLY

(75) Inventors: Jed Richardson, Batavia, IL (US); Torrence Anderson, Overland Park, KS (US); Robert Kopp, Wheaton, IL (US)

(73) Assignee: Suncast Corporation, Batavia, IL (US)

( * ) Notice: Subject to any disclaimer, the term of this patent is extended or adjusted under 35 U.S.C. 154(b) by 264 days.

(21) Appl. No.: 10/628,636

(22) Filed: Jul. 25, 2003

(65) Prior Publication Data

US 2005/0016999 A1 Jan. 27, 2005

(51) Int. Cl.
*B65F 1/14* (2006.01)

(52) U.S. Cl. ..... 220/4.32; 220/908

(58) Field of Classification Search ..... None
See application file for complete search history.

(56) References Cited

U.S. PATENT DOCUMENTS

| | | | | |
|---|---|---|---|---|
| 4,173,287 | A * | 11/1979 | Kumakawa | 217/65 |
| 4,765,579 | A * | 8/1988 | Robbins et al. | 248/101 |
| 4,923,080 | A | 5/1990 | Lounsbury | |
| 5,348,222 | A | 9/1994 | Patey | |
| 5,390,818 | A | 2/1995 | LaBuda | |
| 5,803,300 | A | 9/1998 | DeMars | |
| 5,984,134 | A | 11/1999 | Mario | |

* cited by examiner

*Primary Examiner*—Stephen Castellano
(74) *Attorney, Agent, or Firm*—McHale & Slavin PA

(57) ABSTRACT

The present invention relates to kit for a trash container utilizing injection molded plastic panels capable of being packaged and shipped in a knocked-down state and constructed into a secure container.

18 Claims, 8 Drawing Sheets

SECURE TRASH CONTAINER ASSEMBLY

FIELD OF THE INVENTION

This invention relates generally to a trash container assembly constructed of plastic structural panels. More specifically, the present invention relates to a trash container assembly utilizing injection molded plastic panels capable of being packaged and shipped in a knocked-down state and constructed into a secure and decorative trash container.

BACKGROUND INFORMATION

Refuse containers are a necessity for homeowners and business owners alike. Typically, refuse containers are positioned in convenient locations for trash disposal in the proximity of people using an area of a business or home. A common form of a trash container comprises a rigid body which forms an internal chamber with there being an access opening provided within a rim at the upper end of the internal chamber. A lid is connectable with the rim to close the access opening. When the lid is removed, trash is able to be thrown into and collected within the trash can body. Most modern refuse containers also house a separate, removable waste receiving receptacle such as a collapsible plastic bag. A common form of a trash bag is constructed of flexible plastic which is held open by folding the bag over the lip of the container to facilitate the placing of trash into the bag. Once the bag is filled, the top of the liner is tied closed and lifted out of the container. U.S. Pat. No. 5,803,300 discloses rigid one piece a trash container with a bag holding mechanism which firmly supports a flexible walled plastic bag in an open configuration within the container. However, filled bags often seal against the side walls of the container causing difficulty in lifting the filled bags. U.S. Pat. No. 5,390,818 teaches a trash receptacle for receiving and holding a flexible, collapsible trash liner. More particularly, the trash receptacle device provides a cavity formed in the lower portion of the trash receptacle, for use as a foothold for assisting a user in removing a full trash liner from the receptacle and a handhold to assist the user in transporting the receptacle.

Typically, the aforementioned containers provide portability for storage, but lack structural integrity and aesthetic appearance for use in commercial areas. In addition, a major problem with this type of prior art trash container arises when the wind or an animal overturns the trash container and spreads refuse on the ground. This situation is not only unsightly but may also be unsanitary if the receptacle is filled with food type refuse.

In an attempt to overcome the spillage problem trash containers have been provided with an attached top portion for the container. The top portion is usually provided with one or more openings, sometimes closed with a swinging door, through which the refuse may pass to be received by the waste receptacle within the container. The swinging doors are generally provided with a weight, spring, or mechanical mechanism which must be pushed open to place trash in the container. Because the top portion is securely attached to the container portion these containers are generally constructed with access doors in their side to facilitate removing a filled trash bag from the container portion.

U.S. Pat. No. 5,348,222 teaches a pedal operated garbage container with improved access to the interior when the lid is opened. In this container, a platform for supporting waste is pivoted to the opposite side walls at its forward edge, and a front wall extends upwardly from the forward edge of the platform. Operation of a pedal pivots the platform upwardly and the front wall outwardly, providing access to the interior. One or more waste receptacles are placed on the platform, and must be lifted out for emptying as needed. This is a relatively complex structure, with several internal pivotal linkages within the container linked to the pedal actuator.

While providing a partial solution to the overturning problem, the access doors used to place trash into this type of device often become unsanitary and transfer germs when they become soiled by one user and a second user must push the door open with their hand to place refuse in the container. In addition, most animals are capable of pushing the doors open and entering the container, but once inside they are unable to pull the door open to get out of the container without help.

U.S. Pat. No. 4,923,080 teaches a trash receptacle that opens on the side so that the filed bag need not be lifted out of the receptacle.

U.S. Pat. No. 5,984,134 teaches a trash container formed with an open fronted housing having a pivotally mounted front wall movable between a closed position and an open position displaced from the open front to allow a full trash bag to be removed readily from the housing, without having to lift the bag up and clear of the open upper end of the housing. A releasable locking device releasably locks the front wall in the closed position.

Typically, the structure of such devices are complex requiring numerous small metal and/or plastic fasteners and connector members to maintain a structurally sound container. Due to the complexity of these devices they are generally only offered to consumers fully assembled and not in a kit form and therefore require large shipping containers or crates, thereby increasing the final cost of the product to the consumer.

Such prior art systems, while working well, have not met all of the needs of manufacturers to provide a product that can be easily manufactured, packaged and shipped to the consumer in a kit form. Nor have they met the needs of consumers requiring structural integrity combined with aesthetic appearance and ease of assembly without the need for tools and small fasteners for assembly.

Paramount among such needs is a panel system which creates a trash container having walls which resist panel separation, buckling, racking and weather infiltration. Structural integrity is a further consideration, the box formed by the panels must tie into the cover and bottom in such a way as to unify the entire enclosure. Also, from a safety standpoint, a cover should be present which can be easily latched and which provides dependable pivoting access to the lined trash container.

There are also commercial considerations that must be satisfied by any viable trash container kit; considerations which are not entirely satisfied by state of the art products. The trash container must be formed of relatively few component parts that are inexpensive to manufacture by conventional techniques. The trash container box must also be capable of being packaged and shipped in a knocked-down state.

Finally, there are ergonomic needs that a trash container kit must satisfy in order to achieve acceptance by the end user. The trash container must be easily and quickly assembled using minimal hardware and requiring a minimal number of tools. Further, the trash container must not require excessive strength to assemble or include heavy component parts. Moreover, the trash container kit must assemble together in such a way so as not to detract from the internal storage volume of the resulting trash container or otherwise detract from the internal storage volume of the resulting assembled trash container or otherwise negatively affect the utility of the assembled trash container.

BRIEF DESCRIPTION OF THE INVENTION

The present invention provides a kit, of injection molded plastic panels having integrated connectors which is capable of being packaged and shipped in a knocked-down state and constructed to form a secure trash container. The integrated connection of the side wall, cover and bottom panel components simplifies trash container construction. The panels are formed of injection molded plastic to interlock with one another without the need for separate metal fasteners or connectors. The system incorporates a minimum number of components by integrally forming the connectors into the injection molded panels which are snapped together. This construction eliminates the need for separate extruded or molded connectors or fasteners to assemble the trash container. Injection molding allows the panels to be formed with integral cross-bracing, ribs and gussets for increased rigidity when compared to blow molded or rotationally molded containers. The same side wall and bottom panel components can be used to create a variety of trash containers and the assembly of the trash container requires minimal hardware and a minimum number of hand tools.

The bottom, left and right wall panels have outwardly projecting locking posts for interlocking cooperative engagement with sockets in the front and back panels. The front and back side wall panels are constructed with inwardly contoured sockets for interlocking cooperative engagement with the locking posts on the sides of the left and right wall panels. The engagement between the locking posts and the sockets serve to rigidly connect the components together into a weather resistant trash container. The system further includes a two piece latching cover which is hingedly connected and latched into place after the front, back, side and bottom panels have been fully assembled. The retainer portion of the cover is constructed and arranged to cooperate with the side panels to support a conventional plastic trash bag without the need for metal frames, arms or fasteners. The lid portion is hingedly connected to the retainer portion of the cover to provide an opening to place trash in the container. The lid is provided with a latch means constructed and arranged to allow the lid to be latched in a closed position to prevent wind or animals from opening the container.

Accordingly, it is an objective of the present invention to provide a trash container assembly having panels with integrated connectors.

A further objective is to provide a trash container having panels with integrated connectors which accommodate injection molding plastic formation of the panel components for increased structural integrity.

Yet a further objective is to provide a trash container assembly in which the side walls, cover, and bottom panel are integrally interlocked without fasteners.

Another objective is to provide an trash container assembly constructed of modular panels having an aesthetically pleasing appearance.

Yet another objective is to provide a kit for a trash can assembly that is capable of being packaged and shipped in a knocked-down state and constructed into a secure enclosure.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
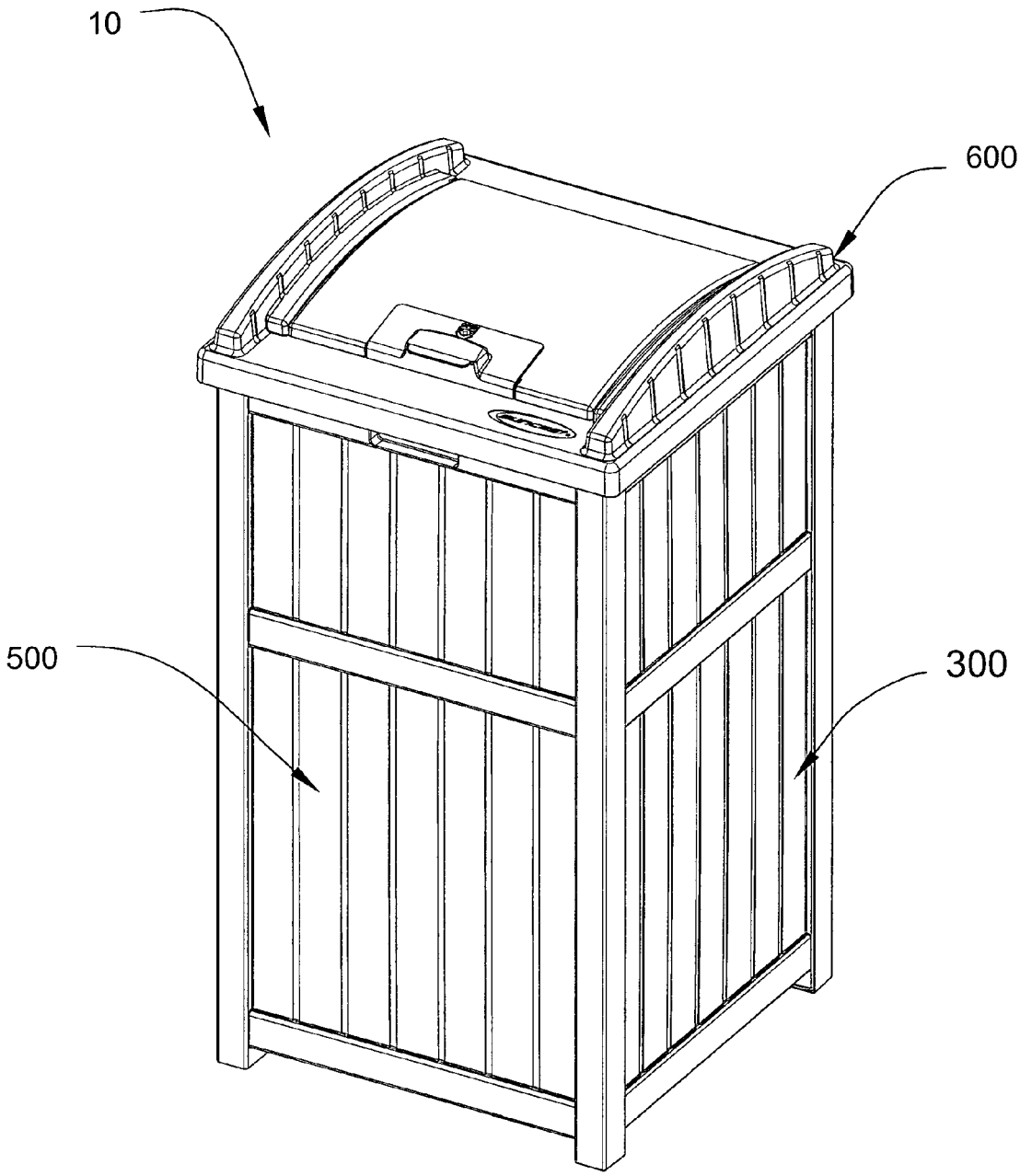
FIG. 1 is a perspective view of one embodiment of the instant invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
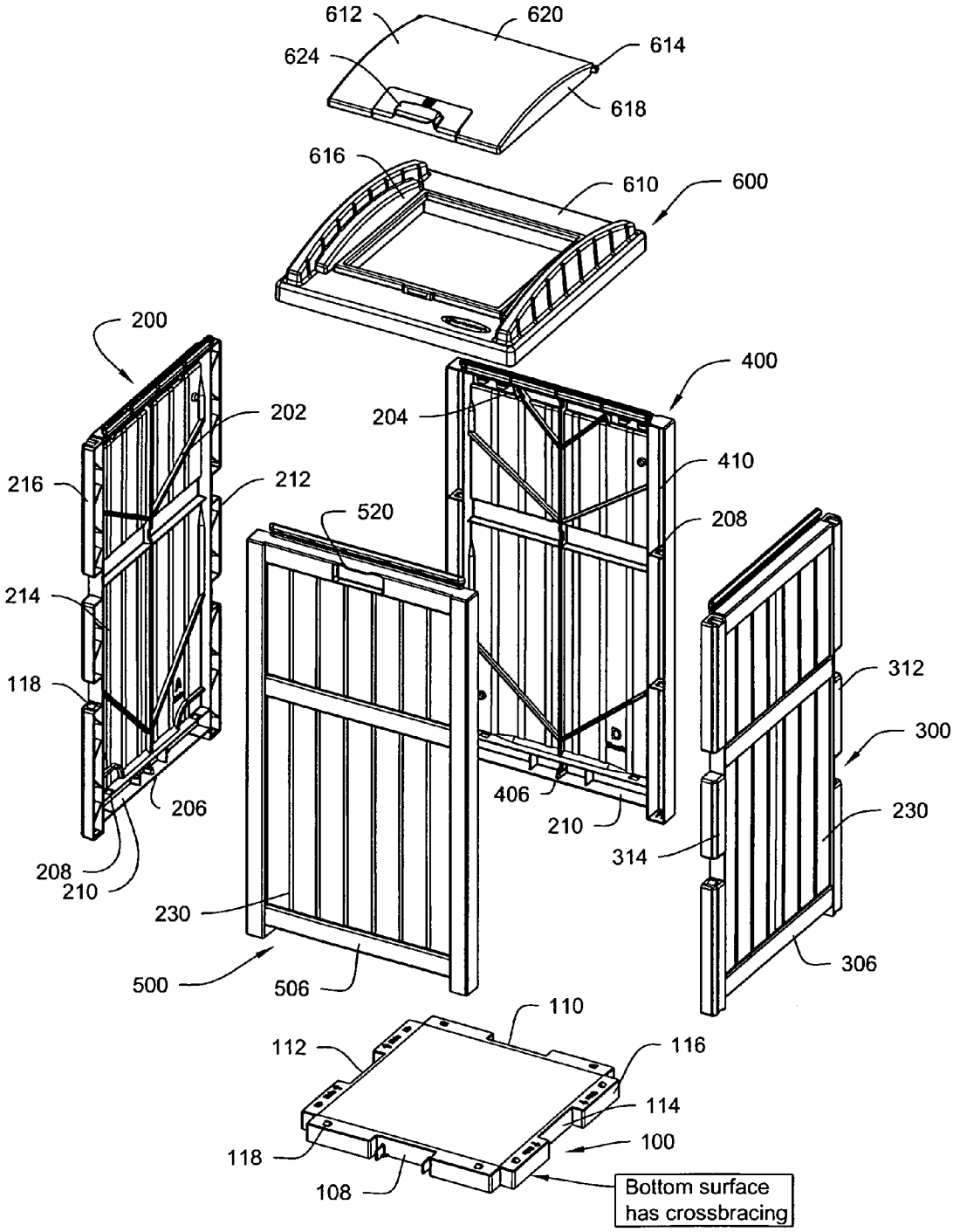
FIG. 2 is an exploded view of the trash container shown in FIG. 1.
Figure 3:
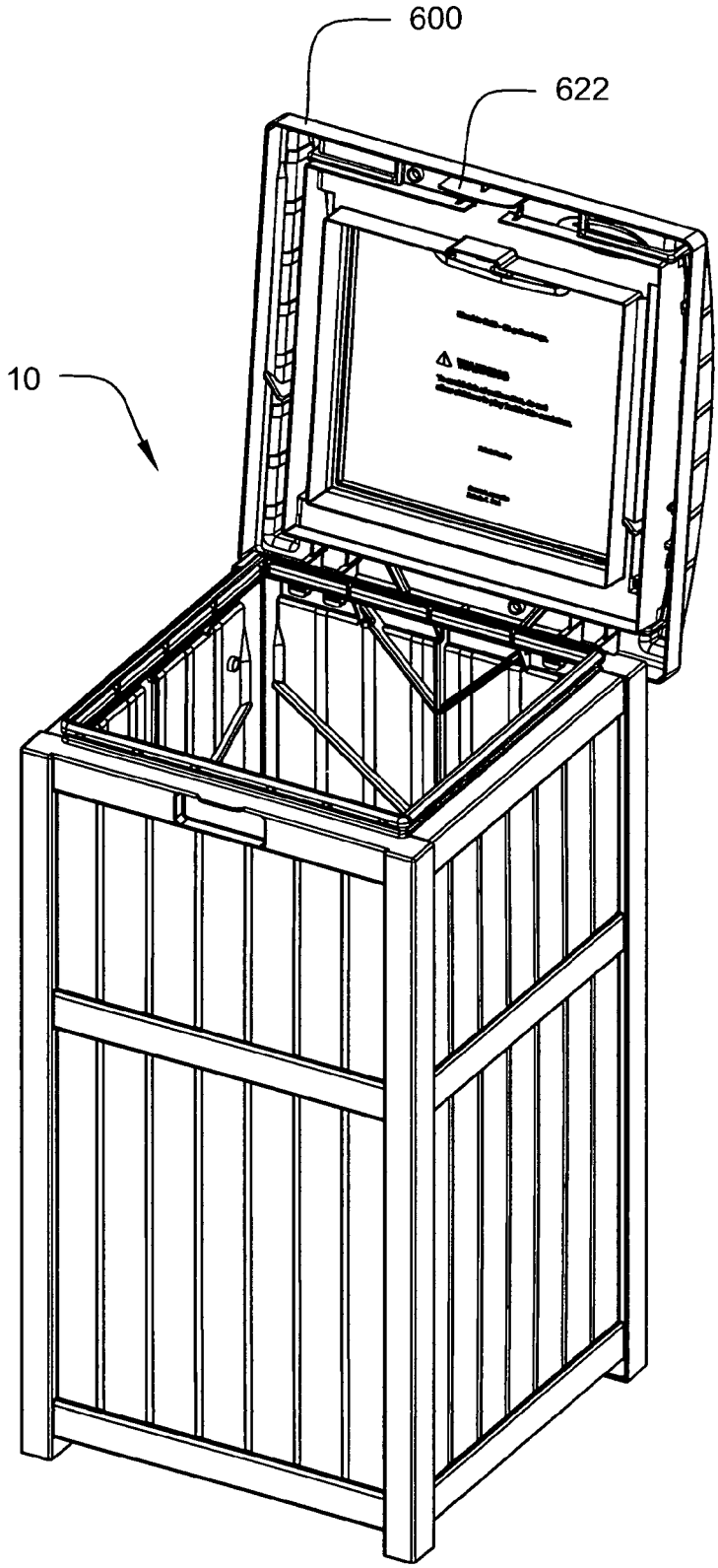
FIG. 3 is a perspective view of the trash container embodiment shown in FIG. 1 with the cover panel in the open position.
Figure 4:
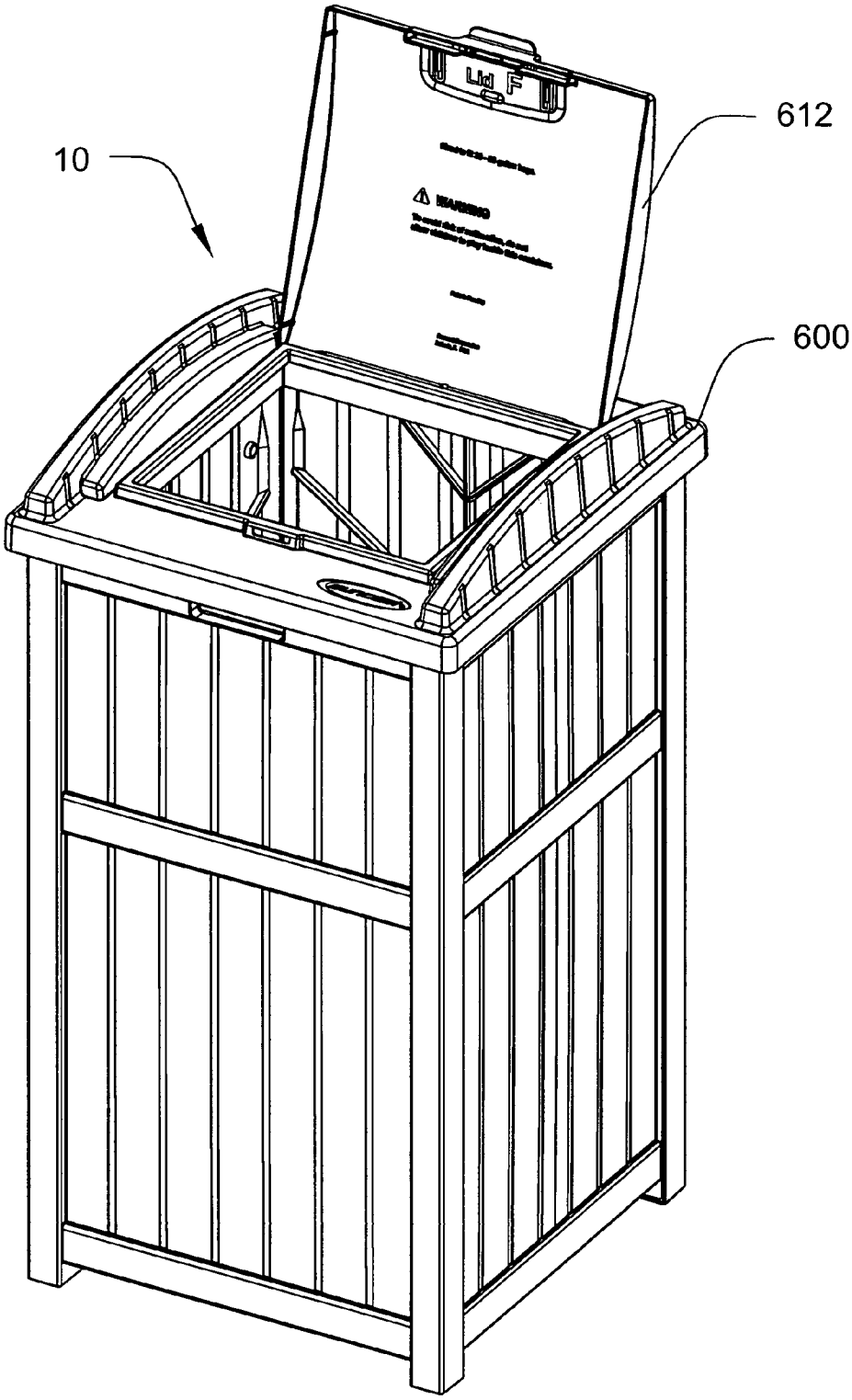
FIG. 4 is a perspective view of the trash container embodiment shown in FIG. 1 with the cover panel in the closed position and the lid panel in the open position.
Figure 5:
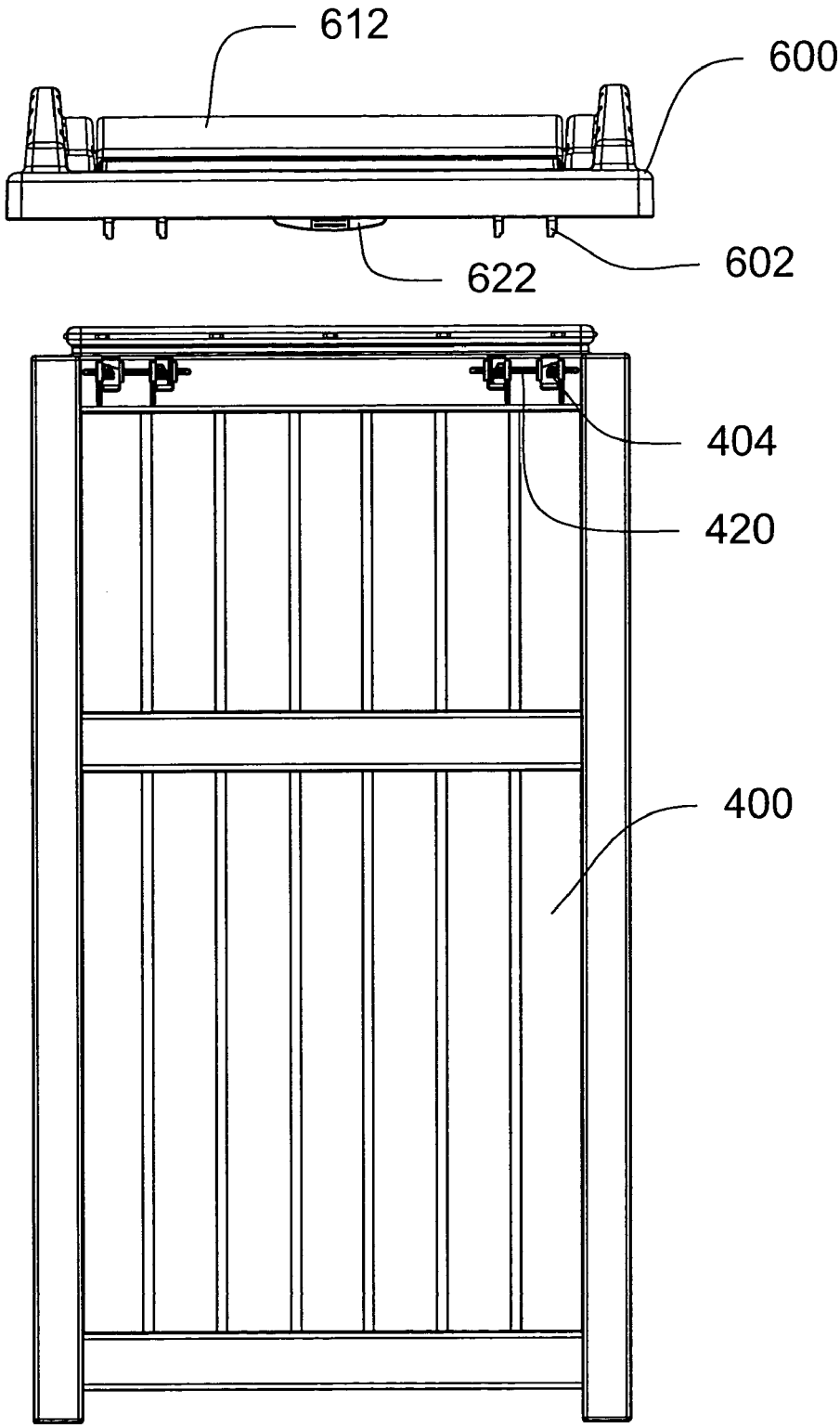
FIG. 5 is a rear view of the trash container embodiment shown in FIG. 1 illustrating the cover hinge means.
Figure 6:
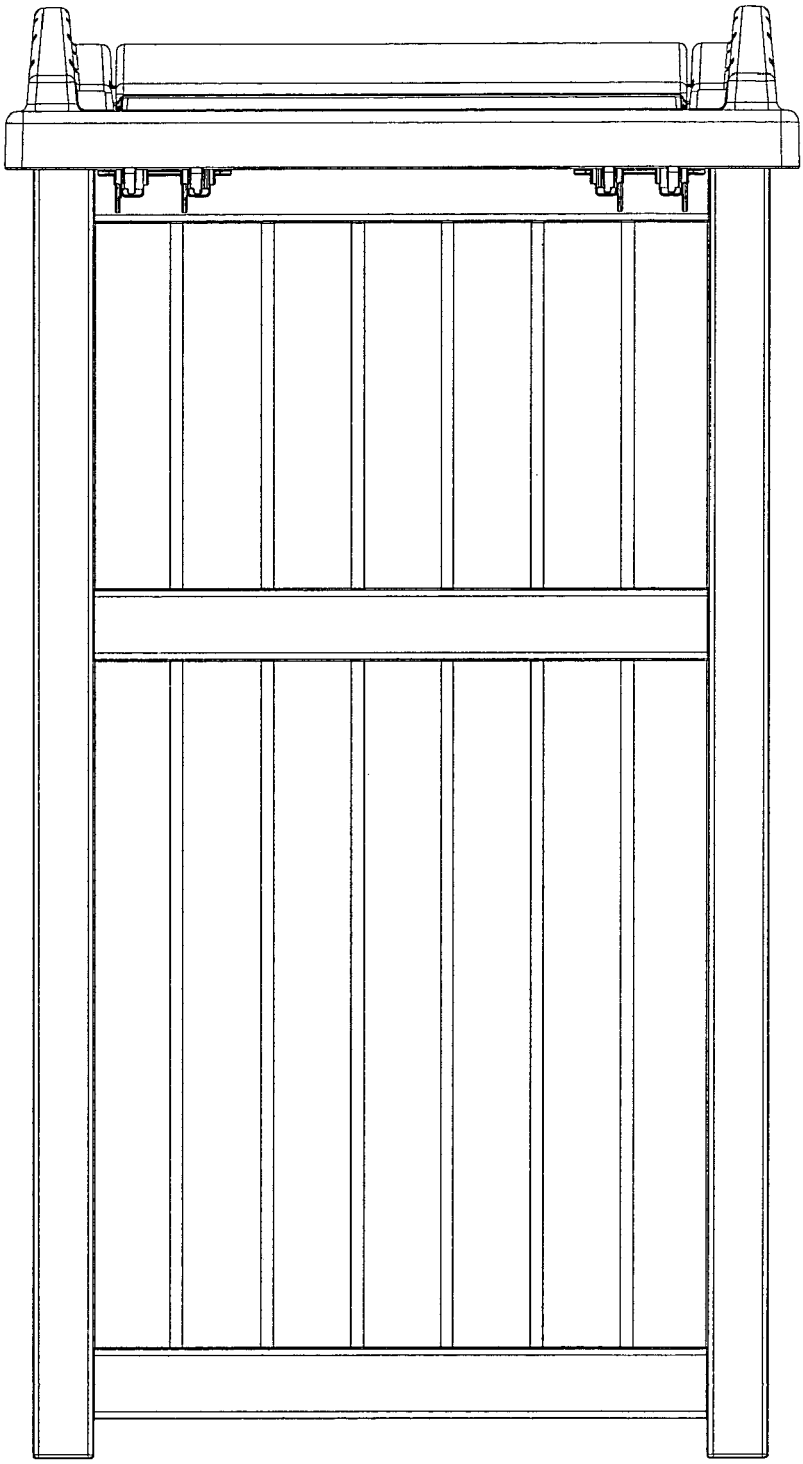
FIG. 6 is a rear view of the trash container embodiment shown in FIG. 1 illustrating the cooperative engagement of the cover hinge pins and the back panel.

FIGS. 1–2 which are now referenced illustrate perspective and exploded views of the trash container assembly, generally referenced as 10, according to a preferred embodiment of the present invention. The trash container is made up of a floor panel 100, left side wall panel 200, right side wall panel 300, back wall panel 400, front wall panel 500 and cover panel 600. In the preferred embodiment, the panels comprising the assembly are formed of but not limited to a suitable plastic such as polystyrene or polyethylene, through the process of injection molding. The result is that the panels comprising the trash container 10 are formed as unitary panels with integral connectors, and cross bracing. Strengthening ribs 202 and gussets 204 are formed within the inner surfaces of the wall panels, cover The lowermost interlocking post on each edge of the left and right panels are feet. The lowermost interlocking socket on each edge of the front and back panels are feet. panel, and floor panel in order to enhance rigidity of the panels while leaving the external surface in a generally smooth condition for aesthetic purposes, as shown in FIG. 2. The floor panel 100 has a top surface 104, bottom surface 106, and like-constructed front, back, left, and right edges 108, 110, 112, and 114 respectively. Along each of the floor panel edges is a means of attaching the floor panel to the left 200, right 300, back 400, and front 500 wall panels illustrated as a plurality of formed interlock posts 116 extending outwardly from each edge. The interlock posts 116 are constructed and arranged to cooperate with interlock sockets 210 extending inwardly along the bottom edges 206, 306, 406, 506 of the left, right, back, and front wall panels respectively. The locking posts 116 and sockets 210 are constructed and arranged so that the locking posts 116 enter and mateably engage the interlock sockets 210 securing the panels together in an inter-fitting engagement and perpendicular arrangement. Detent or snap-type fasteners, such as those illustrated at 118 cooperate with apertures 208, to secure the interlock posts 116 to the interlock sockets 210. Those skilled in the art will appreciate that the snap-type fasteners 118 can be used throughout the trash container 10 to mount or secure components to one another, and to facilitate ready assembly of the trash container if it is provided in an unassembled kit form. The overlapping interlock post 116 and interlock socket 210 arrangement increase the structural integrity of the trash container 10 by preventing the panels 200, 300, 400, 500 from bowing or bending inwardly or outwardly, and thus, adversely affecting the appearance or operation of the trash container 10.

The left wall panel 200 is configured having a first edge 212 and a second edge 214. Both edges 212, 214 include an integrally formed attachment means illustrated as at least one and preferably three elongated contoured interlock posts 216 extending outwardly in a linear fashion along each edge. The interlock posts 216 are generally constructed and arranged to cooperate with the contoured interlock sockets 410 and 510 provided in either edge of the back panel 400 and front panel 500.

The right wall panel 300 is configured having a first edge 312 and a second edge 314. Both edges 312, 314 include an integrally formed attachment means illustrated as at least one and preferably three elongated contoured interlock posts 316 extending outwardly in a linear fashion along each edge. The interlock posts 316 are generally constructed and arranged to cooperate with the contoured interlock sockets 410 and 510 (not shown) provided in either edge of the back panel 400 and front panels 500.

The lowermost interlocking post on each edge of the left and right panels are feet. The lowermost interlocking socket on each edge of the front and back panels are feet.

The outer surface of the panels 200, 300, 400, 500 are constructed generally smooth having a plurality of inwardly bowed grooves 230 for added strength and aesthetic appearance. The inside of the panels 200, 300, 400, 500 are constructed with a plurality of strengthening ribs 202 extending across the panels with a portion of the ribs 202 being provided with a plurality of gussets 204 to further strengthen the panels. The ribs 202 and gussets 204 increase the structural integrity of the trash container 10 by preventing the panels 200, 300, 400, 500 from bowing or bending inwardly or outwardly, and thus, adversely affecting the appearance or operation of the trash container 10. The integrally formed ribs 202 and gussets 204 are facilitated by injection molding. Injection molding offers significant strength and stability advantages over blow-molding or spin molding as utilized in the prior art. In this manner the container of the instant invention is capable of handling a significant amount of weight as compared to prior art plastic trash containers.

The left and right side panels 200, 300 are attached to the floor panel 100 by inserting the contoured interlock posts 116 into the interlock sockets 210 until the spring tabs 118 engage the apertures 208 in the sockets 210 of the left 200 and right 300 panels.

The front and back panels 400, 500 are attached to the left 200, right 300, and floor 100 panels by inserting the contoured interlock posts 116 and 216 into interlock sockets 210 and 410 respectively until the spring tabs 118 integrally formed into the contoured locking posts 116 and 216 engage the apertures 208 in the sockets of the front and back panels 400, 500. It will be appreciated that the purpose of the contoured elongated interlock posts 116 and 216 are to align two panels in a perpendicular relationship and to facilitate their mechanical connection. The perpendicular panels are brought into an overlapping relationship wherein the contoured interlock posts 116, 216 enter the corresponding interlock sockets 210, 410 in the front, back, left, and right panels 200,300, 400, 500 respectively. The result is a mechanically secure connection between the panels. The overlapping edges between the panels as described above provides a secure connection and offers several advantages. First, the design allows the panels to be connected without the need for separate connectors. Second, the design creates a positive lock that prevents separation of the panels. Third, the design maintains alignment of the panels in the same plane and prevents bowing or bending of either panel relative to one another. The resultant trash container created by the combination of the interlocking panels benefits from high structural integrity and reliable operation.

Referring to FIGS. 3–6, perspective and section views of the trash container illustrating the pivotal operation of the cover 600 and lid 612. Also illustrated is the construction and arrangement of the separable hinge means assemblies. The hinge assemblies generally include a plurality of hinge pins 404 and a plurality of cooperating hinge pin receivers 602. The hinge pin receivers 602 are generally a pair of downwardly depending supports 602 located adjacent to the back edge 610 of the cover 600 and are constructed and arranged to cooperate with a cover hinge pin 404 to allow pivotal movement of the cover 600. The hinge pins 404 are each integrally formed into the upper portion of the back panel 400 and supported an outwardly depending support 420. The hinge pins 404 cooperate with their respective hinge pin receivers 602 to allow pivotal movement of the cover 600 and also allow the cover 600 to be removed when in the open position by lifting the cover upward and sliding the hinge pin receiver 602 outward from the pins 404. The cover 600 is releasably secured in place by pivoting the cover downward until the spring latch 622 integrally formed into the cover panel 600 engage at least one corresponding catch 520 formed in the front portion of the front panel 500. The result is a positive mechanical connection.

Figure 7:
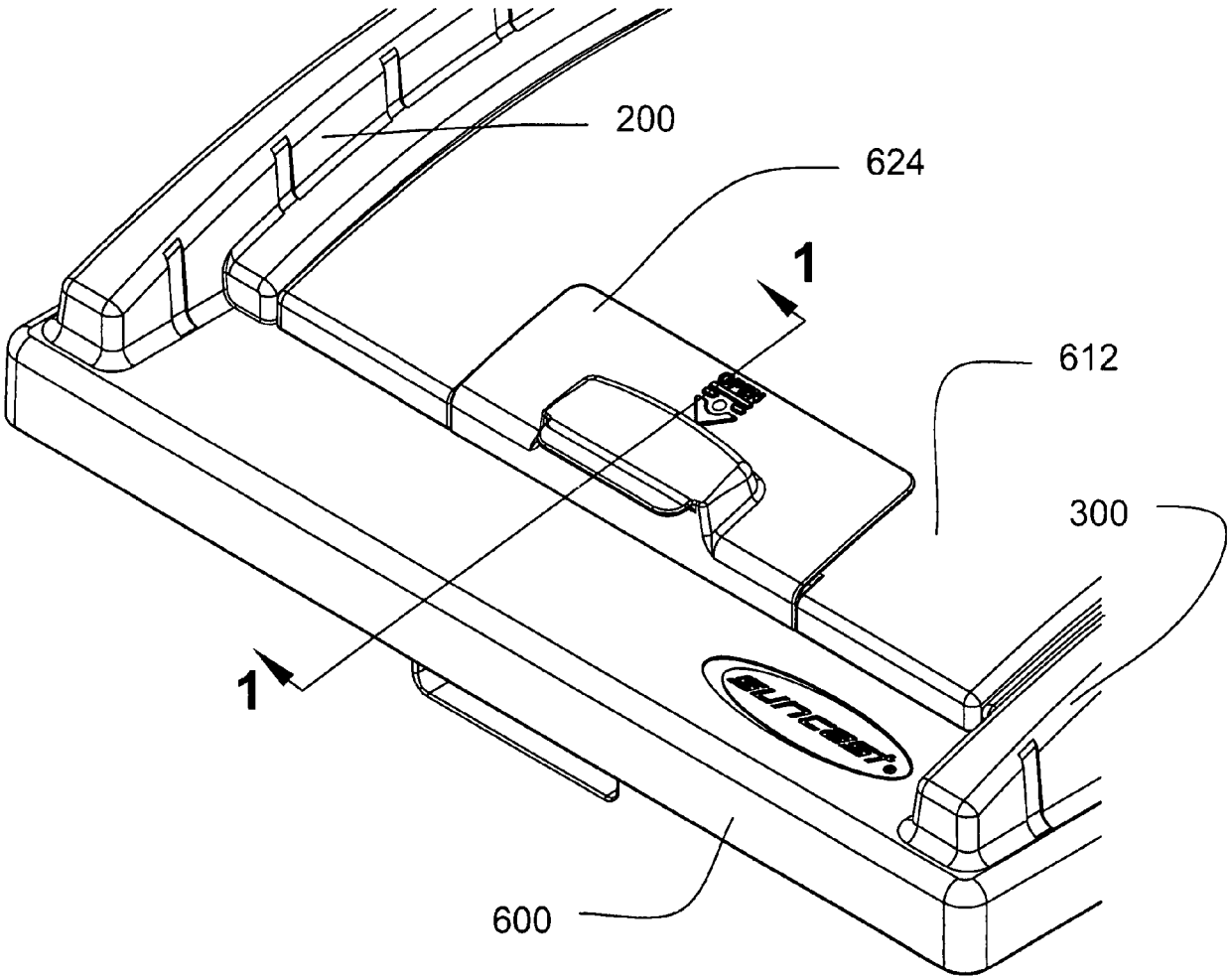
FIG. 7 is partial perspective view illustrating the lid panel latch.
Figure 8:
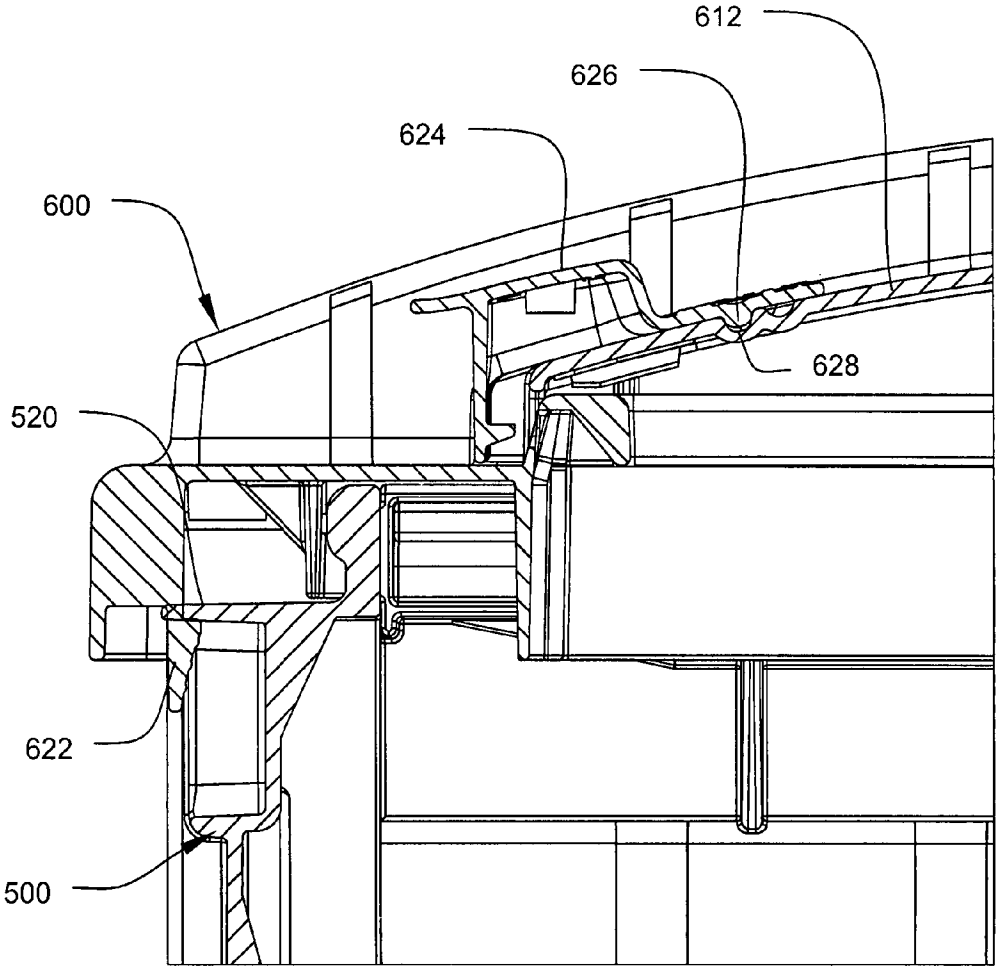
FIG. 8 is a partial section view along lines 1—1 of the trash container embodiment shown in FIG. 7.

Referring to FIGS. 7–8, the removable lid 612 is illustrated in cooperation with the cover panel 600. The lid 612 is constructed and arranged with a hinge assembly to provide pivotal access to the interior of the trash container 10 while it is in the open position. The hinge assemblies generally include a plurality of hinge pins 614 and a plurality of cooperating hinge pin receivers 616. The hinge pin receivers 616 are integrally formed into the top outer portion of the cover panel 600 and are constructed and arranged to cooperate with a lid hinge pin 614 to allow pivotal movement of the lid 612. The hinge pins 614 are each supported by a downwardly depending lip 618 located adjacent to the back edge 620 of the lid 612. The hinge pins 614 cooperate with their respective hinge pin receivers 616 to allow pivotal movement of the lid 612 and also allow the lid 612 to be removed when in the open position by lifting the lid upward and sliding the pins 614 outward from the hinge pin receiver 616.

It should be appreciated that the hinge assemblies allow the cover 600 and/or the lid 612 to be installed and/or removed when the cover 600 or lid 612 is in the open position and yet the cover and lid are secure and non-removable when in the closed position.

The lid 612 is releasably secured to the cover 600 in a closed position by sliding the cover latch 624 inward until the detent 622 integrally formed into the cover latch 624 engages at least one corresponding indentation 628 formed in the front portion of the lid 612. To open the lid 612, the cover latch 624 is pulled outward until the detent 622 is released from the indentation 628 and the lid is pivoted upwards. The result is a positive mechanical connection between the side walls of the container, the cover, and the lid that resists opening by winds or animals, and yet provides easy access for placing trash in the container.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A trash container kit comprising:

a floor panel for enclosing the bottom of a trash container;

a left side panel for enclosing the left side of said trash container;

a right side panel for enclosing the right side of said trash container;

a back panel for enclosing the back of said trash container;

a front panel for enclosing the front of said trash container;

a cover for enclosing the top of said trash container, said cover constructed and arranged to provide ingress into said trash container and facilitate removal of trash from said trash container, said cover constructed and arranged to cooperate with said left, right, back, and front panels to retain a trash bag in an open position within said trash container, said cover including a lid portion hingedly mounted for providing an opening to place trash in said open trash bag;

wherein at least one of said left panel, said right panel, said back panel and said front panel includes;

a bottom edge having two downwardly extending feet constructed and arranged to engagingly cooperate with adjacent panels;

a top edge including an upwardly extending lip constructed and arranged to cooperate with said cover panel to secure a trash bag in an open position;

a first edge having an attachment means constructed and arranged to cooperate with an adjacent panel in a perpendicular relationship;

a second edge having an attachment means constructed and arranged to cooperate with an adjacent panel in a perpendicular relationship;

wherein said trash container can be shipped in a disassembled state and assembled on a desired site.

2. The trash container kit of claim 1 wherein said floor panel includes;

a top surface constructed and arranged to provide a rigid and stable generally flat surface;

a bottom surface constructed and arranged to provide rigidity and stability to said trash container;

four like constructed edges having a means of attaching said floor panel to said left, right, front and back wall panels.

3. The trash container kit of claim 2 wherein said means of attaching said floor panel to said left, right, front and back wall panels includes a plurality of locking posts arranged in a linear fashion and extending outwardly from said edges, said locking posts constructed and arranged to cooperate with inwardly extending sockets in said left, right, front and back wall panels;

wherein said wall panels are secured to said floor panel via said locking post and said socket cooperation.

4. The trash container kit of claim 2 wherein said bottom surface of said floor panel includes integrally formed cross-bracing;

wherein said cross-bracing provides increased weight capacity and stability to said trash container.

5. The trash container kit of claim 2 wherein said bottom surface of said cover panel includes a groove extending substantially around the perimeter of said bottom surface, said groove constructed and arranged to cooperate with the top edge of said left side panel, said right side panel, said back panel, and said front panel;

wherein said groove increase the structural integrity of said trash container by inhibiting said panels from bowing or bending inwardly or outwardly.

6. The trash container kit of claim 1 wherein said first edge attachment means includes at least one integrally formed elongated contoured interlock post and said second edge attachment means includes at least one integrally formed elongated contoured interlock post;

wherein said at least one first edge elongated contoured interlock post is brought into an overlapping relationship with at least one corresponding elongated contoured interlock socket in said back panel and said at least one second edge elongated contoured interlock post is brought into an overlapping relationship with at least one corresponding elongated interlock socket in said front panel resulting in a mechanically secure connection between said left, front and back panels.

7. The trash container kit of claim 1 wherein said back panel includes;

a top edge having an attachment means constructed and arranged to cooperate with said cover panel in a pivotable relationship.

8. The trash container kit of claim 7 wherein said top edge cover attachment means includes at least one hinge pin constructed and arranged for receiving a cover panel hinge pin receiver;

wherein said hinge pin receiver allows said cover to be installed and removed when said cover is in an open position and said cover is secure and non-removable when in a closed position.

9. The trash container kit of claim 1 further including two downwardly extending feet on said bottom edge of said back panel are constructed and arranged to overlap and mateably engage downwardly extending feet of said left and said right panels securing said panels together in an inter-fitting engagement, thereby increasing the structural integrity of said trash container by inhibiting said panels from bowing or bending inwardly or outwardly.

10. The trash container kit of claim 1 wherein said first edge attachment means includes at least one integrally formed elongated contoured interlock socket and said second edge attachment means includes at least one integrally formed elongated contoured interlock socket;

wherein said at least one first edge elongated contoured interlock socket is brought into an overlapping relationship with at least one corresponding elongated contoured interlock post on said first edge of said left panel and said at least one second edge elongated contoured interlock socket is brought into an overlapping relationship with at least one corresponding elongated interlock post on said first edge of said right panel resulting in a mechanically secure connection between said right, left and back panels.

11. The trash container kit of claim 1 wherein said front panel includes;

a top edge including an attachment means constructed and arranged to cooperate with said cover panel in a securely releasable relationship.

12. The trash container kit of claim 11 further including said two downwardly extending feet on said bottom edge of said back panel are constructed and arranged to overlap and mateably engage downwardly extending feet of said left and said right panels securing said panels together in an inter-fitting engagement, thereby increasing the structural integrity of said trash container by inhibiting said panels from bowing or bending inwardly or outwardly.

13. The trash container kit of claim 11 further including first edge attachment means includes at least one integrally formed elongated contoured interlock socket and said second edge attachment means includes integrally formed elongated contoured interlock socket;

wherein said at least one first edge elongated contoured interlock socket is brought into an overlapping relationship with at least one corresponding elongated contoured interlock post on said left panel and said at least one second edge elongated contoured interlock socket is brought into an overlapping relationship with at least one corresponding elongated interlock post on said right panel resulting in a mechanically secure connection between said right, left and back panels.

14. The trash container kit of claim 11 wherein said top edge cover attachment means includes at least one catch plate, said catch plate constructed and arranged to cooperate with a spring-lock depending from said cover for releasably securing said cover in a closed position.

15. The trash container kit of claim 1 wherein said cover includes;

a top surface, said top surface including a pivotally attached lid member, said lid member including a latch means for releasably securing said lid member to said cover;

a bottom surface constructed and arranged to cooperate with said front panel, said back panel, said left panel, and said right panel;

a front edge having a latch means constructed and arranged for releasably securing said cover to said front panel;

a back edge having an hinge means constructed and arranged for pivotable securement of said cover to said back panel;

a left closed edge; and a right closed edge.

16. The trash container kit of claim 15 wherein said hinge means includes at least one hinge pin integrally formed on said back edge, said at least one hinge pin constructed and arranged to cooperate with said at least one hinge pin receiver;

wherein said hinge pin receiver allows said cover to be installed and removed when said cover is in an open position and said cover is secure and non-removable when in a closed position.

17. The trash container kit of claim 16 wherein said cover latch means includes at least one spring lock depending from said bottom surface of said cover, said spring lock constructed and arranged to cooperate with said at least one catch plate on said front panel for releasably securing said cover.

18. The trash container kit of claim 15 wherein said lid member latch means includes sliding latch, wherein said sliding latch has a first locked position and a second unlocked position.

* * * * *